US006196802B1

(12) United States Patent
Matsumoto

(10) Patent No.: US 6,196,802 B1
(45) Date of Patent: Mar. 6, 2001

(54) AXIAL FLOW FAN

(75) Inventor: Kaoru Matsumoto, Miyota-machi (JP)

(73) Assignee: Minebea Co., Ltd., Nagano (JP)

( * ) Notice: Subject to any disclaimer, the term of this patent is extended or adjusted under 35 U.S.C. 154(b) by 0 days.

(21) Appl. No.: 09/179,404

(22) Filed: Oct. 27, 1998

(30) Foreign Application Priority Data

Oct. 29, 1997 (JP) ..... 9-296992

(51) Int. Cl.[7] ..... F04D 29/38

(52) U.S. Cl. ..... 416/229 R; 416/213 R; 416/244 R; 415/216.1

(58) Field of Search ..... 416/229 R, 204 R, 416/213 R, 241 A, 244 R; 415/216.1, 217.1, 215.1, 220; 417/353, 354

(56) References Cited

U.S. PATENT DOCUMENTS 5,135,363 * 8/1992 Harmsen et al. ..... 417/354
5,399,070 * 3/1995 Alizaden ..... 416/229 R
5,871,335 * 2/1999 Bartlett ..... 416/244 R

* cited by examiner

*Primary Examiner*—Edward K. Look
*Assistant Examiner*—Richard Woo
(74) *Attorney, Agent, or Firm*—Staas & Halsey LLP

(57) ABSTRACT

An axial flow fan having impeller blade section fixed in a rotor of a motor where shaft supporting the rotation of the rotor is fitted to intermediate fastening section, and boss, which holds the synthetic resin fan with fan blades, surrounds and firmly connects the intermediate fastening section. The shaft is made from metal, and this allows a secure press fit with the metal intermediate fastening section. The neck joining the intermediate fastening section and the boss has a through hole for the shaft to pass and supporting arms project between boss and intermediate fastening section. In addition, the connecting sections between the shaft and the intermediate fastening section, and the boss and the intermediate fastening section may be knurled.

9 Claims, 5 Drawing Sheets

AXIAL FLOW FAN

BACKGROUND OF THE INVENTION

The present invention relates to an axial flow fan with a strengthened coupling between the impeller blades and boss.

In the axial flow fan, the entire fan motor is flat in shape in order to mount the motor structure in the center of the fan. Because of this, the volume required for installation is small and the fan can be mounted simply on the side wall of an equipment, and so fans of this type are widely used for cooling in office automation equipment.

In normal axial flow fans, the stator of the motor passes through and is held in place by supporting arms in the center of a shallow round or square shaped cylindrical frame. The rotor rotates freely around the outside of this stator, and the impeller blades extend from this rotor in the direction of emission. The rotor causes the blades to revolve and causes air to flow in the axial direction of the frame. Normally, when the impeller blades are made from plastic resin, the shaft in the center of the stator is coupled to the boss in the center of the impeller shaft section by molding.

Conventionally, it has been usual to apply knurling to the molded resin shaft with the aim of reducing vibration during rotation, firmly fixing the shaft and increasing the strength of the bond between blade section boss and shaft. However, in cases where the ambient temperature is high and operation is carried out for a long time, heat generated by the rotor and stator causes the shaft to grow hot and expand by a very small amount. After operation is stopped, the shaft cools and shrinks back to its original size. When this process is repeated, the heat of the shaft during rotation cause the resin to soften and worsens the perpendicularity of the shaft in relation to the blades. The socalled shaft inclination and the rotational balance of the blades deteriorates, causing vibration during rotation.

The present invention is directed to overcoming the above disadvantages. This objective is accomplished by providing an axial flow fan consisting of impeller blades mounted in a rotor of the motor, by which the shaft supporting the rotor and the boss holding the blades are more firmly coupled, thus ensuring a longer service life for this coupling.

SUMMARY OF THE INVENTION

In order to achieve the above-mentioned object, the present invention provides an axial flow fan consisting of impeller blades mounted in a rotor of a motor, by which an intermediate fastening section is provided for the shaft which supports the rotation of the rotor, and the boss holding the synthetic resin impeller blades which form the sides of the blades surrounds the said intermediate fastening section to establish a close coupling.

The next present invention provides an axial flow fan further having a metal shaft into which the metal intermediate fastening section is fitted and fastened.

The other present invention provides an axial flow fan further having an intermediate fastening section possessing a hole through which pass the shaft and the neck coupled to the boss.

The another present invention provides an axial flow fan further having an intermediate fastening section possessing a hole through which pass the shaft and the neck coupled to the boss, and mounting arms extending from the intermediate fastening section to the boss.

The another present invention provides an axial flow fan further having a knurled section on the coupling between the shaft and the intermediate fastening section.

The another present invention provides an axial flow fan further having a knurled section on the coupling between the intermediate fastening section and the boss.

DESCRIPTION OF THE PREFERRED EMBODIMENTS

Figure 1:
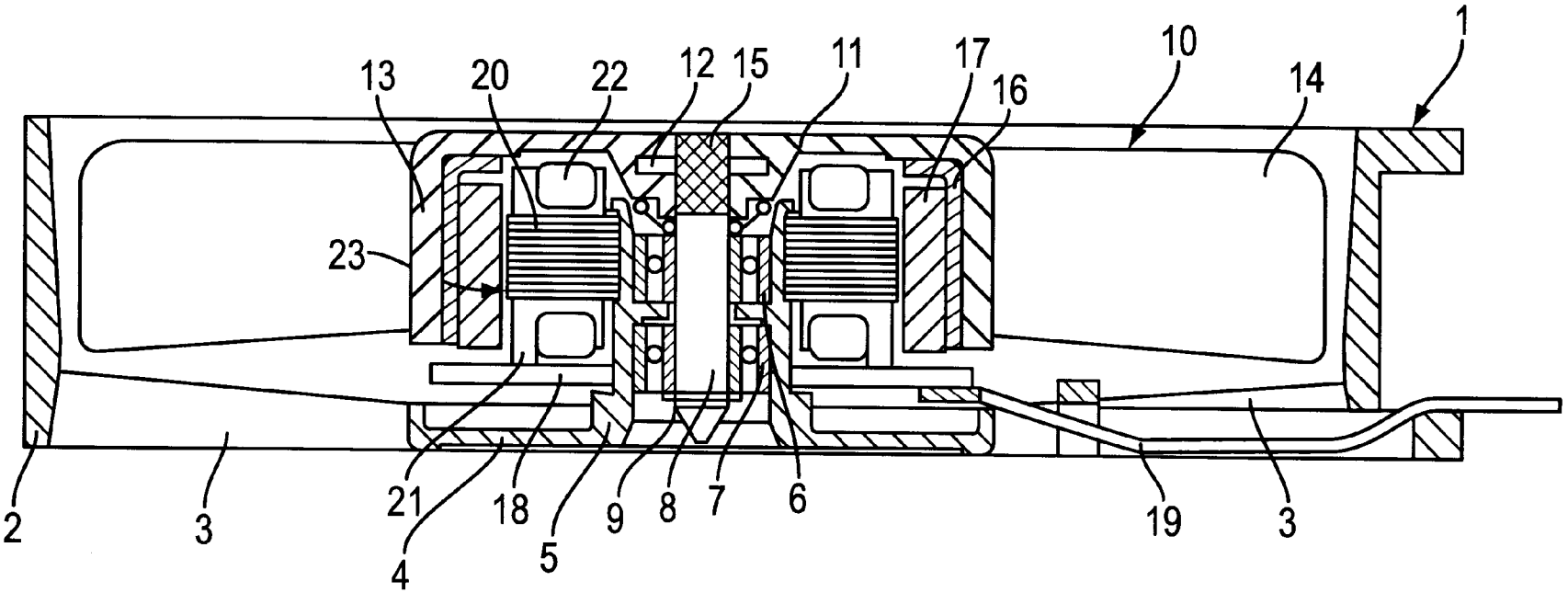
FIG. 1 is a sectional view showing an axial flow fan constructed according to a preferred embodiment of the present invention.

Embodiments of the present invention will now be described in detail with reference to the accompanying drawings. FIG. 1 is a sectional view showing an axial flow fan constructed according to a preferred embodiment of the present invention. In FIG. 1, the casing 1 contains the cylindrical venturi 2, with its inner surface formed at an angle, and supporting arms 3 extending from the venturi 2 inwards holding the bearing box 4 in a one-piece structure. On the inside of the mount 5 in the center of the bearing box 4 there are two bearings 6 and 7. The inside of bearings 6 and 7 support the shaft 8 and allow it to rotate freely. The collar 9 keeps the shaft 8 in place.

Figure 2:
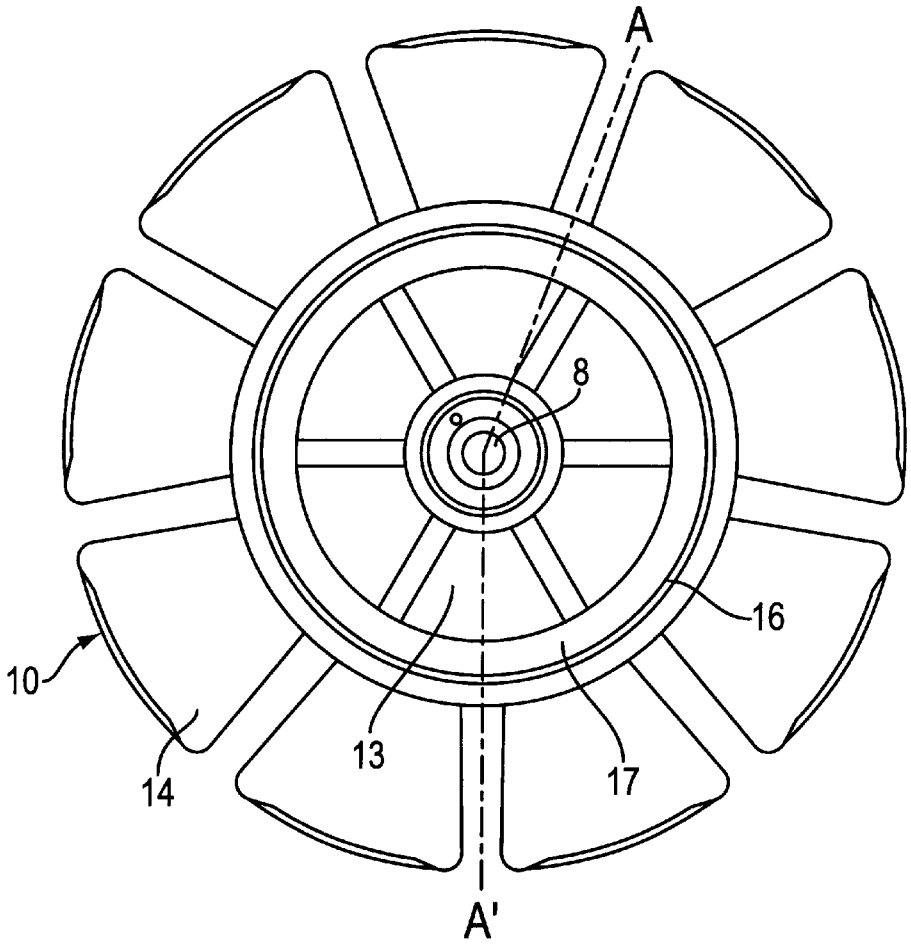
FIG. 2 is a front view of the rotor.
Figure 3:
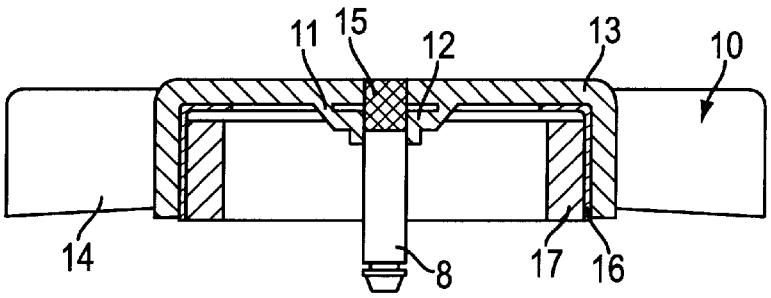
FIG. 3 is a sectional view of the rotor.

FIG. 2 shows plan views of the rotor and impeller blades. FIG. 3 is a sectional view of the rotor along the line A-O-A' of FIG. 2. As illustrated by FIGS. 1, 2 & 3, shaft 8 is made to form a single piece with the boss 11 of the impeller blade section 10 by the intermediate fastening section 12 formed from a ring shaped metal sheet being pressed in an approximately vertical direction into the axis. The boss 11 is surrounded by the cap 13, from which extend a plurality of blades 14 in the emission direction. The above ring shaped intermediate fastening section 12 fits into the knurled section 15 of shaft 8 thus firmly holding shaft 8 in place. A yoke 16 is fitted to the inside of cap 13, and its cylindrical inside wall retains the radially magnetized magnet 17.

A circular PC board 18 is fitted below and around the mount 5 of bearing box 4 and upon this board are mounted electronic components and the drive circuit which drives the axial flow fan. The lead wire 19 supplies electric power. Around the circumference of mount 5 are fitted a core 20 comprising fixed magnets and yokes. Coil 22 passes through insulator 21 and is wound around core 20. Core 20 and stator coil 22 make up the stator 23.

The axial flow fan configured as described above operates as follows. When an electric power supply voltage is applied via lead wire 19 to the electronic circuit on PC board 18, the cores 20 of stator 23 are excited in a prescribed order. The relationship between the resulting magnetic field and the magnetic field emitted by the magnets 17 cause the impeller blades to rotate around the axis of the shaft 8. This rotation causes the sides of the fan blades 14 to generate a current of air in a constant direction within the venturi 2 inside the casing 1. As shown in FIG. 2, the objective is this one piece structure formed using resin to bind the boss 11 of fan blades 10 onto the shaft 8 with the ring shaped intermediate fastening section 12 pressed vertically onto its axis.

In FIG. 3, the portion of the shaft where the ring shaped intermediate fastening section presses into it has had its surface roughened by knurling, and this has a large effect in strengthening the coupling between the shaft and the fan. In the above embodiment, the intermediate fastening section 12 pressed onto the shaft 8 is shown as being ring shaped, but a square shape may also be used as long as it maintains the perpendicularity between the shaft and the fan.

Figure 4A:
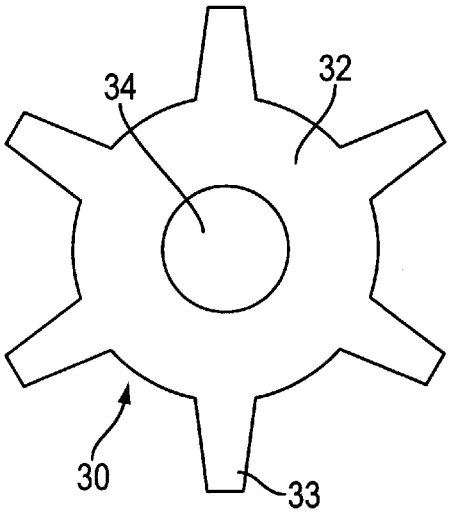
FIG. 4 is a front and a sectional view of the intermediate fastening section.
Figure 4B:
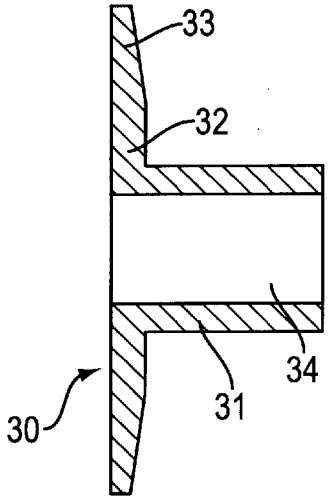

FIG. 4 shows another embodiment, looking at the intermediate fastening section from the same viewpoint, in which (a) is a front view and (b) is a sectional side view. Intermediate fastening section 30 is composed of the cylindrical neck 31 pressing on the tip of shaft 8, flange 32 which projects from the upper edge of neck 31 in a direction orthogonal to the axis of the cylinder, six mounting arms 33 which project from flange 32 in the emission direction, and the through hole 34 in neck 31.

Figure 5:
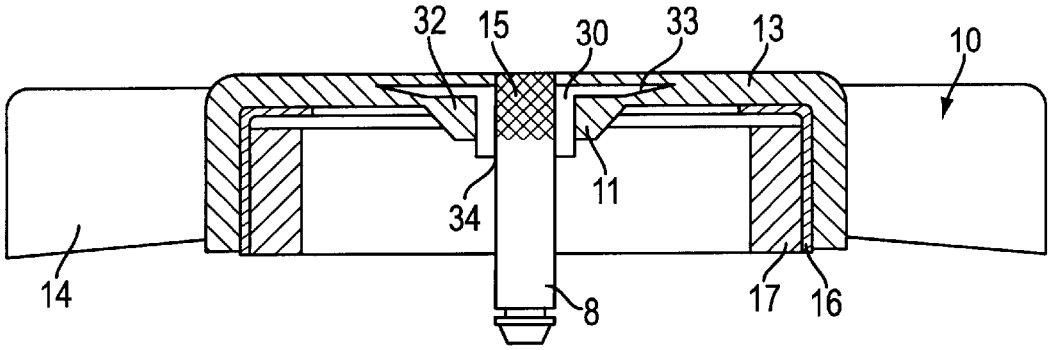
FIG. 5 is a sectional view showing of the rotor according to the second embodiment.

FIG. 5 is a sectional view showing the rotor using the intermediate fastening section 30 illustrated in FIG. 4. As can be seen from FIG. 5, the knurled section 15 of shaft 8 is firmly pressed into through hole 34 of neck 31. In this way, intermediate fastening section 30 forms a single piece with shaft 8 which is molded onto rotor boss 11 to form one unit. Shaft 8 and intermediate fastening section 30 comprise two metal parts press fitted together and so even if the temperature varies looseness and clattering will not easily occur. In addition to rotor boss 11 being tightly fixed to neck 31, the six mounting arms 33 project on the inside of boss 11, firmly securing boss 11 and intermediate fastening section 30 to each other. As a result, shaft 8 and boss 11 are tightly fixed, and even if thermal stress or vibrational shock are received, shaft 8 and boss 11 will not easily separate.

Figure 6A:
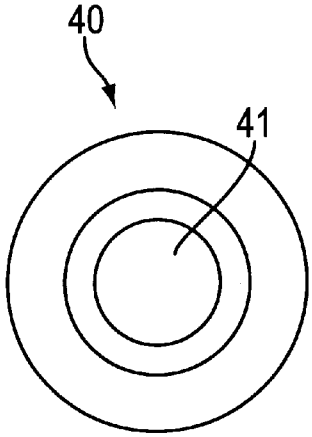
FIG. 6 is a front and a sectional view of the intermediate fastening section according to the 3rd embodiment.
Figure 6B:
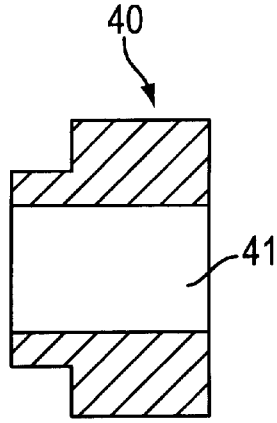

FIG. 6 shows a 3rd embodiment of the intermediate fastening section, in which (a) is the front view of the part and (b) is a sectional view cut along the length of through hole 41. In order to strengthen the coupling to the boss, the side surface of intermediate fastening section 40 can be knurled. In this way, intermediate fastening section 40 forms a single piece with shaft 8 which is molded onto rotor boss 11 to form one unit. Shaft 8 and intermediate fastening section 40 comprise two metal parts press fitted together and so even if the temperature varies looseness and clattering will not easily occur. In addition to rotor boss 11 being tightly fixed to intermediate fastening section 40, boss 11 and intermediate fastening section 40 are rigidly mounted. As a result, shaft 8 and boss 11 are tightly fixed, and even if thermal stress or vibrational shock are received, shaft 8 and boss 11 will not easily separate.

Figure 7A:
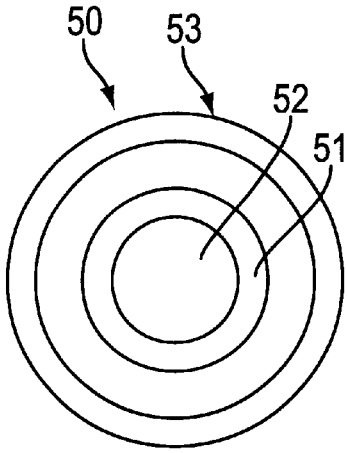
FIG. 7 is a front and a sectional view of the intermediate fastening section according to the 4th embodiment.
Figure 7B:
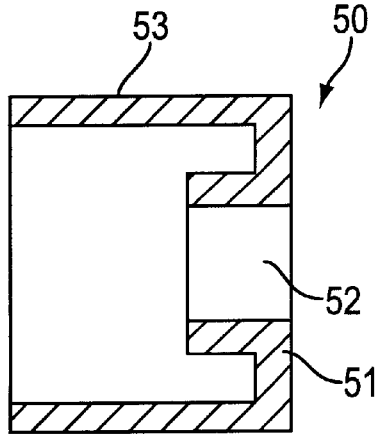

FIG. 7 shows a 4th embodiment of the intermediate fastening section, in which (a) is the front view of the part and (b) is a sectional view. It can be seen from FIG. 7 that intermediate fastening section 50 is formed in a cap shape, in the lower part of which the neck 51 is shaped so as to achieve a coupling with shaft 8, and in the center of which is through hole 52, through which passes shaft 8. In order to strengthen the coupling to the boss, the side surface 53 of intermediate fastening section 50 can be knurled. In this way, intermediate fastening section 50 forms a single piece with shaft 8 which is molded onto rotor boss 11 to form one unit. Shaft 8 and intermediate fastening section 50 comprise two metal parts press fitted together and so even if the temperature varies looseness and clattering will not easily occur. In addition to rotor boss 11 being tightly fixed to intermediate fastening section 50, boss 11 and intermediate fastening section 50 are rigidly mounted. As a result, shaft 8 and boss 11 are tightly fixed, and even if thermal stress or vibrational shock are received, shaft 8 and boss 11 will not easily separate.

Figure 8A:
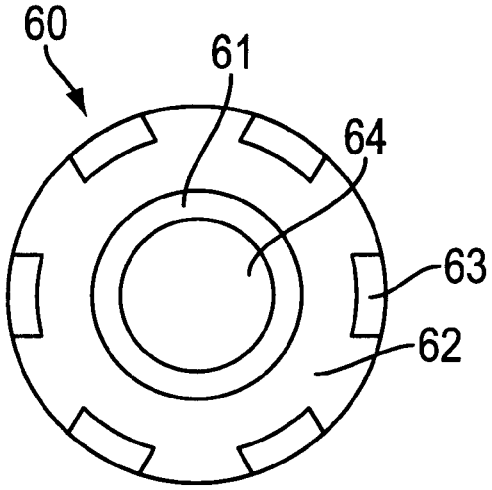
FIG. 8 is a front and a sectional view of the intermediate fastening section according to the 5th embodiment.
Figure 8B:
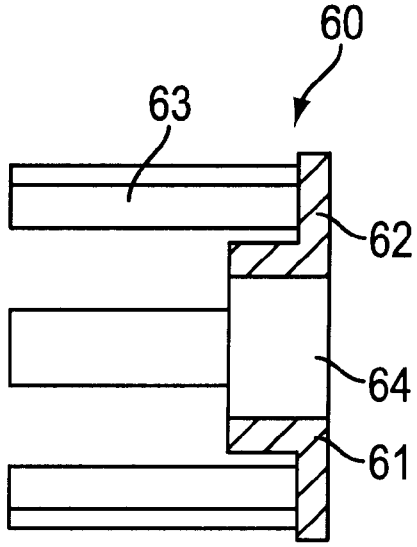

FIG. 8 shows a 5th embodiment of the intermediate fastening section, in which (a) is the front view of the part and (b) is a sectional view. Intermediate fastening section 60 is composed of the cylindrical neck 61 pressing on the tip of shaft 8, flange 62 which projects from the upper edge of neck 61 in a direction orthogonal to the axis of the cylinder, six mounting arms 63 which project from flange 62 in the emission direction, and the through hole 64 in the center of neck 61 through which passes shaft 8.

In the same way as the above embodiments, the knurled section 15 of shaft 8 is press fitted into the neck 61 of through hole 64. In this way, intermediate fastening section 60 forms a single piece with shaft 8 which is molded onto rotor boss 11 to form one unit. Shaft 8 and intermediate fastening section 60 comprise two metal parts press fitted together and so even if the temperature varies looseness and clattering will not easily occur. In addition to rotor boss 11 being tightly fixed to neck 61, the six mounting arms 63 project on the inside of boss 11, firmly securing boss 11 and intermediate fastening section 60 to each other. As a result, shaft 8 and boss 11 are tightly fixed, and even if thermal stress or vibrational shock are received, shaft 8 and boss 11 will not easily separate.

Although the present invention has been described above by means of embodiments, various modifications and applications, for example to the shape of the single unit comprising intermediate fastening section and shaft, are not excluded from the scope of the present invention.

As described above in detail, the present invention uses an intermediate fastening section on the shaft to strengthen the coupling between shaft and fan blades, increase the anti-force of a shaft falls out, and at the same time ensure that the perpendicularity of the shaft with the fan blades is maintained even under excessive operating conditions, with the result that vibration does not increase during rotation.

In the present invention, when a shaft and an intermediate fastening section both were made of metal and engaged fixedly together, the effect of strengthening the coupling between them are increased further.

The other present invention uses a through hole formed in the neck of the intermediate fastening section, into which the shaft is strongly pressed, thus increasing the area of the connecting surface with the boss on the neck, and which allows the strengthening of the coupling between shaft, intermediate fastening section and boss.

In the invention, when the fixing arms was extended on the boss, the strengthening of the coupling between shaft, intermediate fastening section and boss is increased further.

The another present invention, the knurling to the section coupling the shaft and the intermediate fastening section, and to the section coupling the boss and the intermediate fastening section is added, thus making it possible to greatly strengthen the coupling between shaft, intermediate fastening section and boss.

What is claimed is:

1. An axial flow fan having an impeller blade section fixed in a rotor of a motor, comprising:

an intermediate fastening section on a metallic shaft of the motor, said intermediate fastening section being plate shaped and comprising metal materials;

a coupling portion between said intermediate fastening section and a knurled section of said shaft, said shaft pressed with said intermediate fastening section; and a boss portion integrally resin molded with said impeller blade section, wherein said intermediate fastening section is integral with the boss portion, and said impeller blade section includes a plurality of blades integrally formed on an outer circumferential surface of a cup portion by a molding process.

2. An axial flow fan having an impeller blade section fixed in a rotor of a motor according to claim 1, wherein said intermediate fastening section comprises a ring-shaped plate.

3. An axial flow fan having an impeller blade section fixed in a rotor of a motor according to claim 1, wherein said intermediate fastening section comprises a square-shaped plate.

4. An axial flow fan having an impeller blade section fixed in a rotor of a motor according to claim 1, wherein said intermediate fastening section includes a cylindrical neck portion to fit the shaft, one end of said neck portion being formed integrally with a flange formed at one end of the neck portion, said flange having integral arms radiating from an outer circumferential surface, and said arms being into said boss portion by the molding process.

5. An axial flow fan having impeller blade section fixed in a rotor of a motor according to claim 1, wherein said intermediate fastening section comprises a cylindrical tube having a stepped portion, and said stepped portion being into said boss portion by the molding process.

6. An axial flow fan having an impeller blade section fixed in a rotor of a motor according to claim 5, wherein said intermediate fastening section includes a knurled section on an outer circumferential surface.

7. An axial flow fan having impeller blade section fixed in a rotor of a motor according to claim 1, wherein said intermediate fastening section comprises a cup-shaped portion, a cylindrical neck portion to fit said shaft is coaxially formed integrally with said cup-shaped portion at one side, and said cup-shaped portion being into said boss portion by the molding process.

8. An axial flow fan having an impeller blade section fixed in a rotor of a motor according to claim 6, wherein said cup-shaped portion includes a knurled section on an outer circumferential surface.

9. An axial flow fan having an impeller blade section fixed in a rotor of a motor according to claim 1, wherein said intermediate fastening section includes a cylindrical neck portion to fit said shaft, one end of said neck portion being formed integrally with a flange formed at one end of the neck portion, said flange having integral arms axially extending from its outer circumferential edge, and said arms being into said boss portion by the molding process.

* * * * *

UNITED STATES PATENT AND TRADEMARK OFFICE

CERTIFICATE OF CORRECTION

PATENT NO. : 6,196,802 B1
DATED : March 6, 2001
INVENTOR(S) : Kaoru Matsumoto

It is certified that error appears in the above-identified patent and that said Letters Patent is hereby corrected as shown below:

Title page,
Item (75) Inventor, change "Miyota-machi" to -- Nagano --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*